US005373965A

United States Patent [19]

Halm et al.

[11] Patent Number: 5,373,965

[45] Date of Patent: Dec. 20, 1994

[54] COLLAPSIBLE CONTAINER FOR PASTY PRODUCTS

[76] Inventors: Hans Halm, Castroper Strasse 34, D-4590 Herne 1; Manfred Hansen, Lingner & Fischer GmbH, Herrmannstrasse 7, D-7580 Bühl-Baden; Stefan Bender, Bachstr. 41, D-7505 Ettlingen, all of Germany

[21] Appl. No.: 64,090

[22] PCT Filed: Nov. 13, 1991

[86] PCT No.: PCT/EP91/02164

§ 371 Date: Jun. 2, 1993

§ 102(e) Date: Jun. 2, 1993

[87] PCT Pub. No.: WO92/09494

PCT Pub. Date: Jun. 11, 1992

[30] Foreign Application Priority Data

Nov. 22, 1990 [GB] United Kingdom ..... 9025463

[51] Int. Cl.[5] ..... B65D 35/08

[52] U.S. Cl. ..... 222/92; 222/107

[58] Field of Search ..... 222/92, 107

[56] References Cited

U.S. PATENT DOCUMENTS

| | | | |
|---|---|---|---|
| 2,147,349 | 2/1939 | Piquerez | 222/107 |
| 2,400,716 | 5/1946 | Sattler | 222/107 |
| 2,682,355 | 6/1954 | Robbins | 222/107 |
| 3,065,898 | 11/1962 | Daugherty . | |
| 3,288,334 | 11/1966 | Corsette | 222/107 |
| 3,381,818 | 5/1968 | Cope et al. . | |
| 3,595,441 | 7/1971 | Grosjean | 222/107 |
| 4,674,655 | 6/1987 | Löfgrer et al. | 222/107 X |
| 5,174,458 | 12/1992 | Segati | 222/107 X |

FOREIGN PATENT DOCUMENTS

| | | |
|---|---|---|
| 924365 | 9/1947 | France . |
| 024237 | 11/1915 | United Kingdom . |
| 562448 | 7/1944 | United Kingdom . |

*Primary Examiner*—Kevin P. Shaver

*Attorney, Agent, or Firm*—James M. Kanagy; Stuart R. Suter; Edward T. Lentz

[57] ABSTRACT

A collapsible container for extrudable viscous fluids comprising a tube, two opposing side walls of the tube being deformable under applied compressive pressure, the tube closed at one end and open at the other, the open end having a nozzle and openable cap means.

5 Claims, 5 Drawing Sheets

COLLAPSIBLE CONTAINER FOR PASTY PRODUCTS

FIELD OF THE INVENTION

The present invention relates to collapsible containers for extrudable viscous fluids such as toothpaste etc.

BACKGROUND OF THE INVENTION

Containers such as toothpaste tubes in which viscous fluids may be contained and extruded by squeezing through a nozzle are well known. Generally such tubes have a cylindrical cross section over the main part of their length and are folded flat at the closed end e.g. in a "fishtail" closure. A problem with such tubes is that their shape does not allow them to be easily stacked, e.g. for displaying on shop shelves, and consequently they are normally contained within a carton, which is generally of tetragonal shape.

Although the use of a carton enables such tubes to be stacked, the need for this additional packaging is inconvenient in creating extra manufacturing effort, increased cost and a more bulky article requiring more storage space. More seriously this extra packaging is environmentally undesirable both in terms of the use of resources and of the subsequent disposal of the carton. In certain countries this environmental issue is being met by legislation to encourage manufacturers to minimise the amount of excess packaging.

In recent years the problem of excess packaging in the drinks industry has been met by the replacement of rigid bottles by folded cartons, e.g. the known Tetrapak (trade mark), which are generally tetragonal and are readily stackable. The emphasis in producing these cartons has been to introduce rigidity, and hence such cartons are generally unsuitable for use as collapsible containers such as toothpaste tubes. It is an object of this invention to alleviate the above-mentioned problem of excess packaging in the field of collapsible containers for extrudable viscous fluids such as toothpastes.

SUMMARY OF THE INVENTION

According to this invention there is provided a collapsible container for extrudable viscous fluids, comprising a tube, two opposing side walls of said tube being deformable and being biased toward inward deformation under applied compressive pressure, said tube having one closed end and one open end, said open end optionally having a nozzle and openable cap means.

The tube is preferably of substantially rectangular cross-section over a substantial part of its length.

The tube is preferably of substantially rectangular cross-section over at least 25%, preferably over at least 50%, more preferably over 75% or more of its length when filled with its contents.

In use the application of compressive pressure to the side walls of the tube, especially to the side walls perpendicular to the said deformable biased walls, causes the biased walls to deform inwardly thereby causing collapse of the tube and causing any extrudable viscous fluid contents to be extruded from the tube through the open end or through the nozzle when the cap means is open.

By "substantially rectangular cross-section" is meant a cross section in which two pairs of substantially parallel opposing sides are substantially at right angles to each other. These sides may meet in sharp right angled corners or in curved edges, or in chamfered corners, which may themselves meet the sides in sharp corners or curves, so that the section may be polygonal, e.g. hexagonal or octagonal, but having its longest sides in the form of two pairs of substantially parallel opposing sides substantially at right angles to each other. Other shapes which fall within the above term "substantially rectangular" will be apparent to those skilled in the art. The term "rectangular" includes "square".

It is preferred that in a tube of rectangular rather than square cross section the biased sides are the shorter sides, so that the inward deformation of these sides can allow the tube to be collapsed substantially flat as the contents are extruded. It is particularly preferred that the tube has at least one, preferably two, pairs of side walls which are substantially parallel in the longitudinal direction of the tube over a substantial part of the length of the tube, e.g. over 25% or more of the length of the tube, preferably over 50% or more of the length, more preferably over 75% or more of the length of the tube, one pair of which are the biased side walls. Such a tube will then have a generally tetragonal shape over a substantial part of its length, modified only by the shape of the closed end and any nozzle and cap means, and is hence easily stackable.

Preferably all the walls of the tube are deformable so that the entire tube may be made of the same deformable material and may be collapsed completely to extrude all but traces of residual contents, thereby minimising waste. Preferably the tube is made of materials which allow the deformation of walls under gentle hand pressure applied directly by hand or indirectly by means of a dispensing device into which the tube is fitted, so that for example toothpaste may be easily extruded from the tube. Although the walls are deformable it is preferred that they have sufficient mechanical strength, rigidity and/or resilience, to retain the general shape of the tube, especially the above-mentioned preferred generally tetragonal shape, when the tube is filled with its intended contents both in the absence of applied compressive forces and under compressive pressure imposed by stacking. Preferably also the walls have sufficient mechanical strength, rigidity and/or resilience to retain the general shape of the tube, especially the above-mentioned preferred generally tetragonal shape when the tube is empty and in the absence of applied compressive forces.

In such a tube the inward deformation of the biased side walls is preferably by inward folding, so that the tube can ultimately collapse flat, except for residual contents, upon application of compressive pressure and extrusion of the contents. Moreover if inward deformation is by inward folding then collapse of the tube does not result in any outward spreading of the tube beyond the width of the tube between its biased side walls.

The biasing of the walls towards inward deformation may be achieved by an inbuilt concavity in each biassed wall, for example an inward curve, or preferably one or more longitudinal creases in a preferably foldable wall. Such a concavity need only be slight and therefore need not detract from an overall substantially tetragonal shape. Other methods of biasing will be apparent to those skilled in the art, for example points or lines of weakness in the wall. It is particularly preferred to bias the walls by a single unbroken or broken crease in each of the opposing walls running for substantially the entire length of the wall.

The closed end may be closed and sealed by any method which allows the biased side walls to deform inwardly. Preferably the closed end is sealed by folding the walls together and sealing by a method appropriate to the material, e.g. by an adhesive or welding. Suitable folding arrangements will be apparent to those skilled in the art.

In one suitable folding arrangement, opposing end portions (e.g. no more than 10% of the tube length) of the non-biassed side walls are brought together, whilst allowing adjacent regions of the biassed side walls to deform inwardly in accordance with their bias, and these adjacent regions of biassed side walls are folded substantially flat between the end portions of the unbiassed side walls. This forms a substantially flat end flap, e.g. in a "fishtail" arrangement, which may be sealed as described above.

The inward fold of the deformed biassed side walls in the vicinity of this end flap may be accommodated to the rectangular section toward the open end of the tube by a taper, which may be relatively steep so as to accommodate the fold to a rectangular section over a short distance, e.g. 25% or less of the tube length, to achieve a tube of more substantially tetragonal shape, or more gently, for example over up to 50% of the tube length.

Preferred folding arrangements are those which allow the overall general shape of the tube to be substantially tetragonal, e.g. by enabling the closed end to be folded substantially flat, i.e. into a plane perpendicular to the length of the tube, thereby facilitating stacking of the folded tubes and large flat surface areas of the tube walls for display information to be printed thereon. A further desirable feature of an end sealing folding arrangement is the provision of an external flap extending in the direction of the length of the tube, and which may be pulled, thereby causing the immediately adjacent side walls of the tube to be drawn together under the influence of the bias, so enhancing the effect of the bias and encouraging the further inward deformation of the side walls. Such a flap may be capable of being folded flat against the end of the tube to achieve the above-mentioned substantially tetragonal overall shape of the tube. By lightly sticking the folded flap down in this flat position against the end of the tube, the overall generally tetragonal shape of the tube may be maintained during storage but the flap may be easily unfolded prior to use.

A suitable folding arrangement for sealing the end of a tube having two pairs of substantially parallel sides, i.e. of an essentially tetragonal overall shape, and made of foldable materials such as those above-mentioned, comprises introducing an inward, first fold into each of the biased walls, for example along the line of a biassing crease, said first fold being longitudinal and extending only in the vicinity of the end to be closed (e.g. for no more than about 10% of the length of the tube) and thereby enabling the end of the tube to be folded substantially flat by folding the folded biassed walls between the non-biased walls.

The consequent taper of the end of the tube is accommodated to the rectangular cross section of the tube, preferably over as short a length of the tube as possible so as not to detract from the generally tetragonal shape of the tube, by a second fold or bend in each of the non-biassed side walls which are perpendicular to the biased side walls said second fold or bend extending across the width of the tube.

The inward first fold of the biased wall, is accommodated to the rectangular cross section of the tube by two third folds or bends extending from the first fold in the direction of the side walls perpendicular to the biased walls, said third folds or bends forming a substantially "Y" shaped arrangement with the first fold.

The accommodation of the first inward fold to the rectangular cross section of the tube by means of these third folds will necessarily introduce a fourth fold or bend into the biased sides perpendicular to the length of the tube. It is desirable that this fourth fold or bend is at a relatively shallow angle so as not to interfere with the biassing, although in a relatively easily deformable tube material crumpling of the tube material may counteract any structural rigidity introduced by these folds, so as not interfere with the inward biassing.

A further suitable folding arrangement which enables the closed end to be folded substantially flat comprises bringing together end regions (e.g. no more than 10% of the length of the tube) of the non-inwardly-biassed side walls whilst causing or allowing the adjacent inwardly-biassed side walls to deform outwardly against their bias, so as to form a flap portion, which preferably extends substantially in the direction of the long axis of the tube.

Regions of the non-inwardly biassed side walls which are immediately adjacent to the flap portion are bent or folded substantially through 90° so as to form a folded region which is substantially in a plane at 90° to the long axis of the tube.

The flap portion is folded or bent into contact with this folded region, and any "ears" of the flap portion, i.e. parts which extended beyond the plane of the inwardly biassed side walls, are folded or bent into contact with these biassed side walls, if necessary entrapping any other parts of tube material between these ears and the side walls.

The end regions which form the flap portion may be sealed together by for example the methods mentioned above. Optionally the flap portion may be stuck to the folded portion, and/or the biassed side walls, preferably using a relatively weak adhesive which may be broken by a consumer. Folding arrangements of this type are known for other applications, e.g. soft drinks cartons.

In a further suitable arrangement for forming a substantially tetragonal tube, a preformed substantially flat end closure may be sealed onto the end of a tube preferably in a plane substantially perpendicular to the length of the tube. This preformed and closure may be provided with biassing to cause inward deformation on collapse of the tube, for example creases or folds may be made in the performed end closure.

The open end of the tube will in most practical applications be closed with a nozzle and openable cap means for example of the type used on conventional toothpaste tubes. The nozzle may be formed integrally with the tube walls e.g. by a folding arrangement or as an integral moulding, but it is preferred to use a separate nozzle attached to the tube by conventional means such as welding, adhesives etc. Suitable nozzle and openable cap means will be apparent to those skilled in the art.

The container of the invention may be made by methods conventional to the packaging art and appropriate to the material of which the walls are made. For example the tube may be formed in a substantially rectangular cross section by extrusion of a substantially rectangular-sectioned tube or by folding a sheet of the material into a tube and sealing the tube along its length.

During this folding creases may be introduced at appropriate places on the sheet to provide the bias and to facilitate the subsequent formation of the folds or bends described above although these creases may be introduced at any stage of the manufacturing process. Having formed the tube in this way it is generally convenient to then attach a nozzle cap means, then to fill the tube via the end which is to become the closed end, then finally to fold and seal the tune. By filling via the end which is to become the closed end an advantage is achieved in that an air pocket may be retained in the closed end which enables the initial inward deformation of the biassed walls thereby encouraging further inward deformation. Moreover if the closed end is provided with an external flap as mentioned above such an air pocket assists the drawing together of the immediately adjacent side walls.

A variety of materials may be used for the walls of the tube. It is essential that the walls are in practical terms substantially impermeable and inert with respect to the intended contents of the tube. It is desirable that the materials are cheap for mass produced products such as toothpastes, environmentally acceptable on disposal, and capable of being decorated by printing, labelling or other appropriate means. Preferred materials are foldable and include metal foils such as aluminium alloys, plastics materials such as polyethylene, polypropylene, polyvinylchloride (PVC), nylon, paper or board treated to make them in practice substantially impermeable to the contents, and composite materials such as multi-plastics layer materials, paper-plastics material, paper-plastics material-metal foil or plastics material-metal foil laminates. The latter class, composite materials is particularly preferred.

The container of this invention is suitable for containment of such extrudable viscous fluids as food products (e.g. soft cheese, pate, fish pastes, dairy products such as creams etc., confectionary such as cake icing etc.), adhesives, cleansing products such as shampoos, shower gels etc., and toothpaste (particularly striped toothpaste as the deformation characteristic of the tube appear to reduce internal mixing of contents and consequent disruption of stripes), which are conventionally contained in collapsible tubes from which they are extruded by pressure, generally by hand pressure in the case of for example toothpastes.

Striped toothpastes and methods of packing them into collapsible containers of the general class of the invention are well known.

For such uses the dimensions of the tube may be determined by the application for which it is intended, for example toothpaste is generally sold in containers containing 50–200 ml, a convenient volume for household use being 75–175 ml.

In use the container of the invention may be used in an entirely conventional manner by applying hand pressure to squeeze the contents out through the nozzle means. As well as providing flat rectangular areas for display without the need for a carton, the tube of the invention appears to allow an unexpectedly high proportion of its contents to be extruded by hand squeezing. Alternatively the container may be used together in a dispenser of the type having a casing in which the tube is contained with its nozzle means projecting, and in which the tube is squeezed progressively from its closed end by squeezing means such as one or more advancing rollers, jaws etc. Suitable dispensers are described in for example GB 2088818A, GB 12002703, GB 602639, GB 461299, AU 8291166, DE-OL 3610268, U.S. Pat. No. 4,575,375, U.S. Pat. No. 4,331,265, U.S. Pat. No. 4,226,336, U.S. Pat. No. 4,019,655, DE-OL 2340073 etc. For use in such dispensers it is an advantage that the closed end is provided with the above-mentioned extended flap to guide the tube into the squeezing gap.

BRIEF DESCRIPTION OF THE DRAWINGS

The invention will now be described by way of example only with reference to the accompanying drawings in which:

FIGS. 2A–2G shows in greater detail the closure of the closed end of the tube of FIG. 1 by a folding arrangement.

DETAILED DESCRIPTION OF THE INVENTION

Figure 1A:
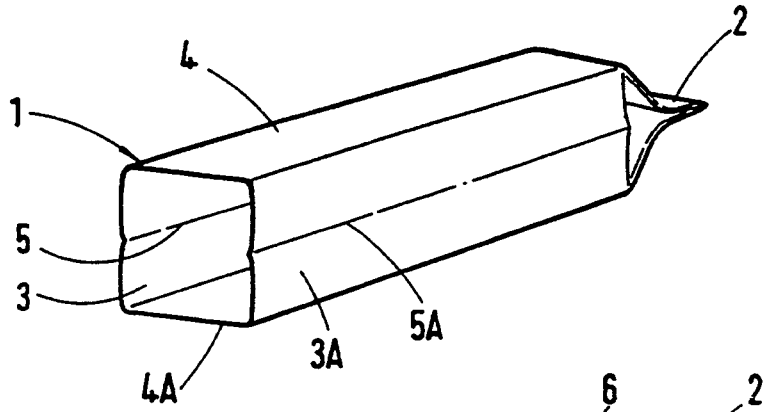
FIGS. 1A–1D shows a tube of this invention in general perspective view.

Referring to FIG. 1A, a tube of the invention is shown in overall perspective view, having an open end 1, and a closed end 2. As shown the closed end 2 has a "fishtail" type seal, described in more detail below, in which the folding of the closed end is accommodated by a relatively steep taper to the rectangular section further along the tube.

The tube has a square cross section and two pairs 3, 3A, 4, 4A of longitudinally generally parallel side walls resulting in an overall generally tetragonal shape. The side walls 3, 3A are biassed toward inward deformation by a longitudinal crease 5, 5A in each wall extending for substantially the entire length of the side wall 3, 3A. Side walls 3, 3A, 4 and 4A are made of deformable materials.

Figure 1B:
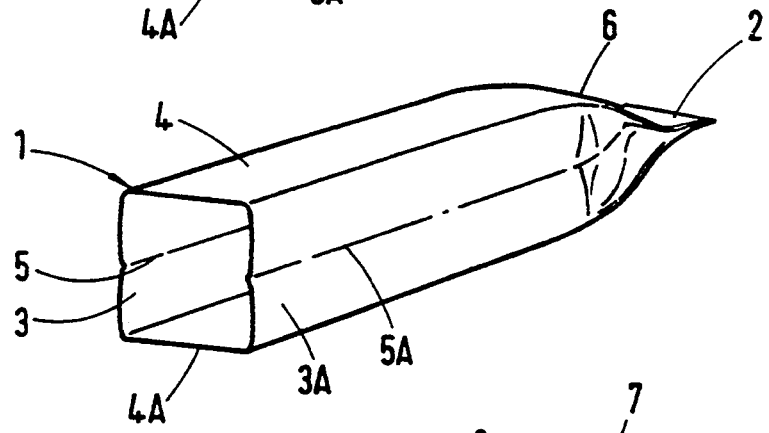

Referring to FIG. 1B, compressive pressure has been applied to the side walls 4, 4A at the point 6 and corresponding point 6A (not shown). This has resulted in an inward deformation of the biassed side walls 5, 5A in the vicinity of the closed end 2 by inward folding along the line of the creases 5, 5A, and a consequent inward collapse of side walls 4, 4A in the vicinity of the closed end 2.

Figure 1C:
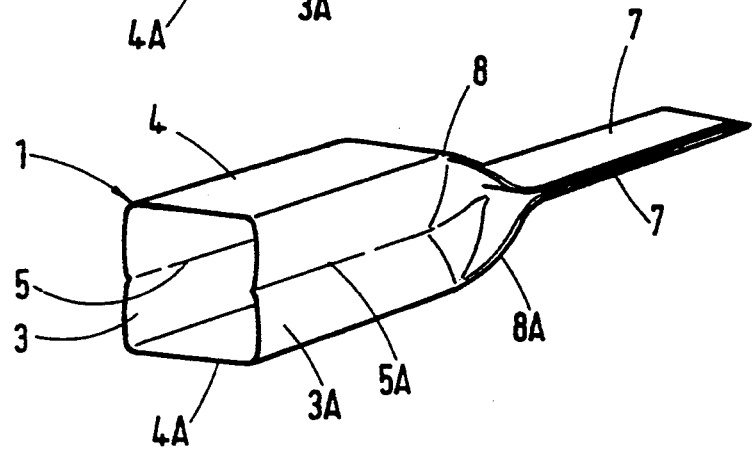

Referring to FIG. 1C, further application of compressive pressure along the length of the side walls at points 7, 7A in addition to points 8, 8A has resulted in further inward deformation of side walls 3, 3A by inward folding of the side walls 5, 5A along the line of creases 5, 5A so that the side walls 4, 4A have collapsed completely over the portion of the tube 9 in the vicinity of the closed end.

Figure 1D:
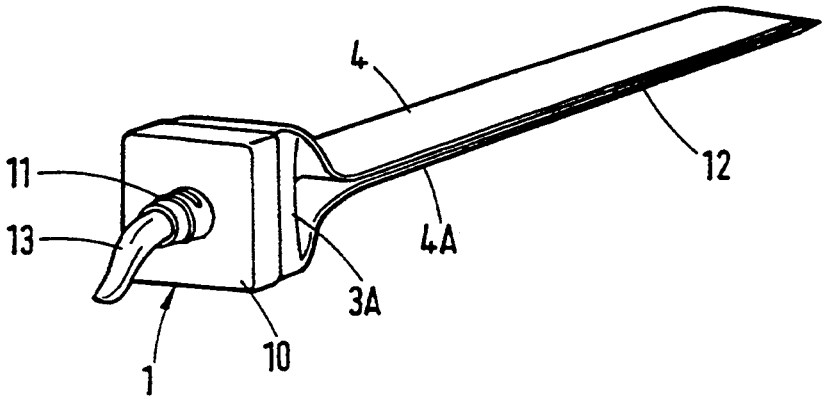

Referring to FIG. 1D, the tube of FIGS. 1A–1B is shown having its open end 1 fitted with a nozzle means 10 having a screw nozzle 11 which can be closed by a screw cap (not shown). The nozzle means is fitted into the tube by entirely conventional means. Progressive application of compressive pressure along the side walls 4, 4A has resulted in further inward folding of the side walls 3, 3A so that the bulk 12 of the tube has collapsed substantially flat. The collapse of the tube has resulted in extrusion of toothpaste contents 13.

Figure 2A:
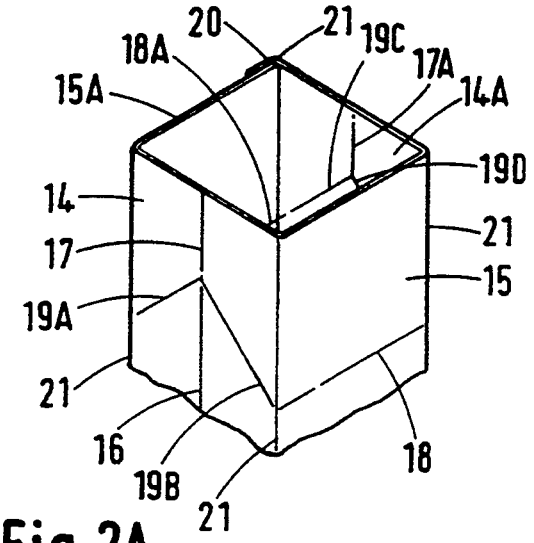

FIGS. 2A–2E show a possible folding arrangement of the closed end 2 of the tube. Referring to FIG. 2A, an end of a tube of rectangular cross section is shown overall, being made of foldable materials. The tube has two pairs of parallel side walls, one pair 14, 14A being shorter than the other 15, 15A. In the shorter side walls 14, 14A is a crease 16, 16A biassing the side walls 14, 14A toward inward deformation by inward folding.

The side walls 14, 14A are scored with further creases 17A, 18 (and a corresponding crease (not shown) on side wall 15), 19A, 19B, 19C, 19D, which are deeper than creases 16, 16A so as to facilitate folding along these creases.

The tube is formed by a conventional folding operation and sealed by an overlapping flap 20 fastened to side wall 15A. The tube may of course be extruded as a square section tube. The corner folds 21 and all of the above-mentioned creases (16, 16A, 17, 17A, 18, 19A, 19B, 19C and 19D) are all formed in the same folding operation.

Figure 2B:
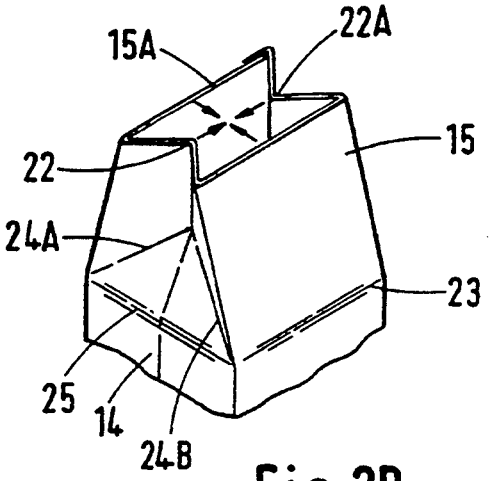
Figure 2C:
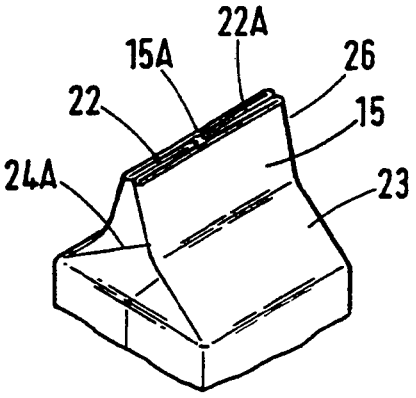

Referring to FIGS. 2B and 2C, an inward first fold 22, 22A is introduced into the biassed side walls 14, 14A along the line of creases 17, 17A. This introduces a taper into the end of the tube, which is accommodated to the rectangular cross section by second fold 23 along the line of crease 18. The inward first fold 22, 22A is accommodated to the rectangular cross section of the tube by formation of third folds 24A and 24B along the lines of creases 20A and 20B. The accommodation of first inward fold 22, 22A to the cross section of the tube by third folds 24A and 24B results in fourth bend 25, being a relatively gentle curve, which does not significantly interfere with inward deformation of the tube as described with reference to FIG. 1 above.

In FIG. 2C the end 2 of the tube is shown closed by the closing of folds 22 and 22A. Closure may be completed by sticking side walls 15, 15A together to form a flap, shown generally 26.

Figure 2D:
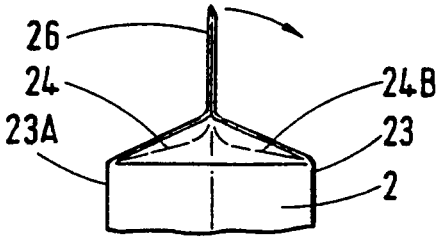
Figure 2E:
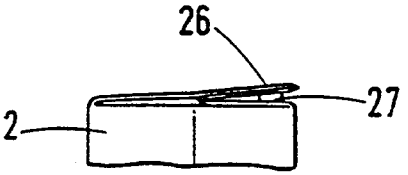

Referring to FIG. 2D, the closed end 2 of the tube, closed by the folding procedure described above is shown orthogonally. Flap 26 is shown projecting. As shown in FIG. 2E by folding flap 26 in the direction shown by the arrow, it can be folded substantially flat to maintain the generally overall tetragonal shape of the tube. By means of a weak adhesive patch 27 the flap 26 may be stuck down during storage but pulled up as shown in FIG. 3A prior to use of the tube.

Figure 3A:
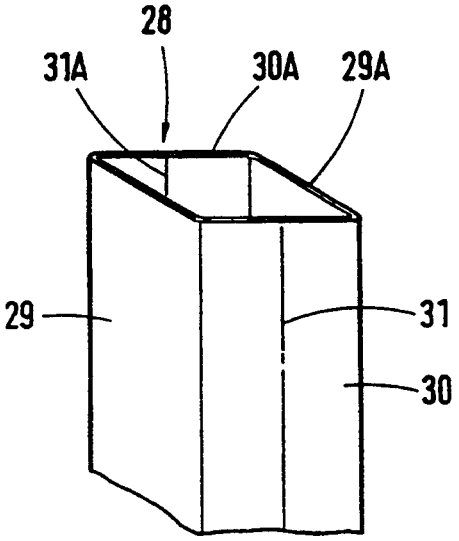
FIGS. 3A–3E shows an alternative end-folding arrangement.

FIGS. 3A–3E show an alternative closing arrangement for the closed end 2 of a tube of the invention. In FIG. 3A the end of a tube is shown overall 28, being an extruded tube of generally square cross-section. The tube 28 has opposing pairs of unbiassed side walls 29, 29A and side walls 30, 30A which are biassed toward inward deformation by creases 31, 31A.

Figure 3B:
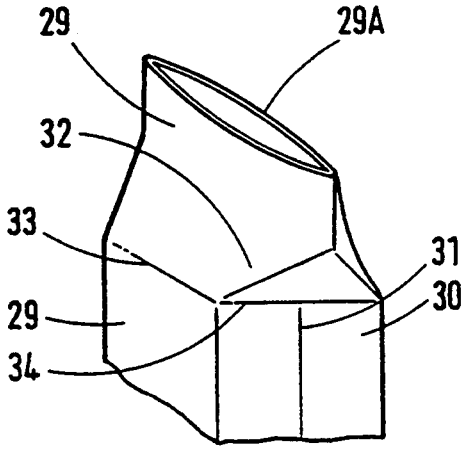

In FIG. 3B inward pressure has been applied to unbiassed side walls 29, 29A in the direction shown by the arrows, so as to urge them together into contact. This has caused a corresponding outward deformation of inwardly-biassed side walls 30, 30A, and formation of first folds 32, first bend 33 and second bend 34.

Figure 3C:
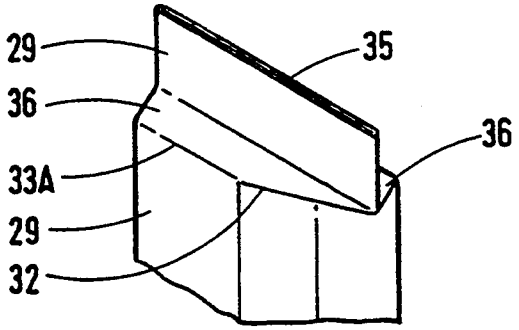

In FIG. 3C side walls 29, 29A have been brought into contact and stuck together by an adhesive (not shown) to form flap 35. First bend 33 has formed a first fold 33A, and regions 36 of the end of the tube immediately adjacent to flap 35 have been folded through approximately 90° to lie substantially in a plane perpendicular to the long axis of the tube.

Figure 3D:
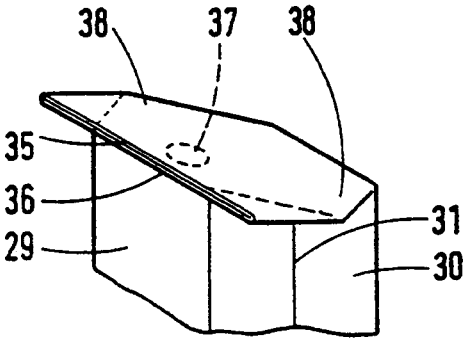

In FIG. 3D, flap 35 has been folded through 90° down into contact with region 36, and has been stuck thereto by a small patch 37 of hot melt adhesive. "Ears" 38 of the flap 35 extend beyond the plane of walls 30, 30A.

Figure 3E:
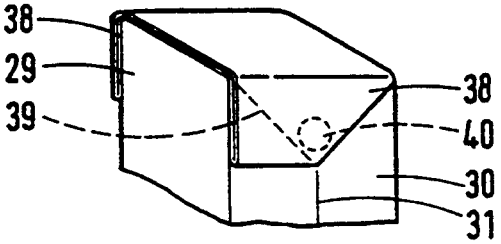

In FIG. 3E, ears 38 have been folded down against side walls 30, 30A. A small portion of tube wall material 39 (shown dotted) is trapped between ear 38 and wall 30, and is stuck to side wall 30 by a small patch of hot melt adhesive 40 to form a tube of substantially tetragonal shape.

Figure 4:
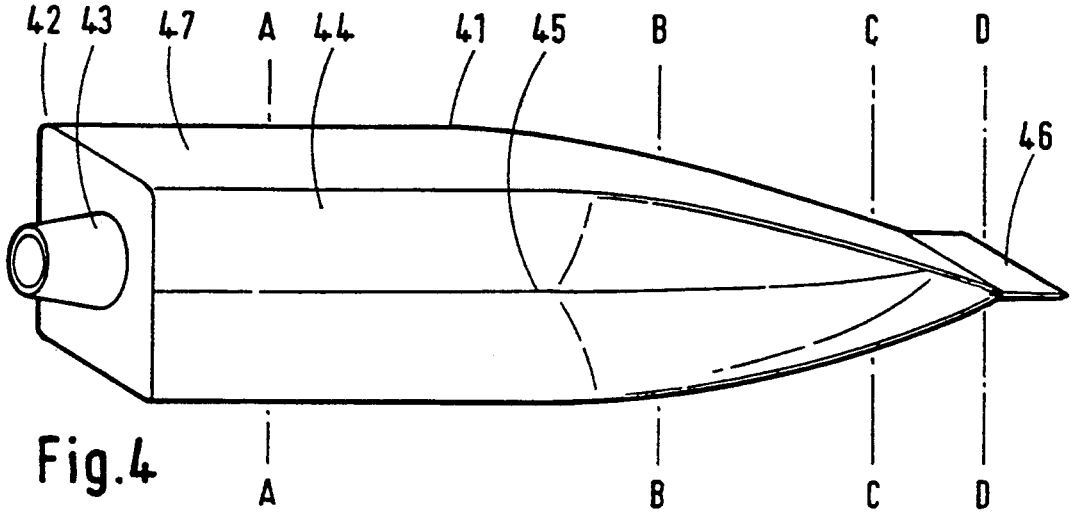
FIGS. 4 and 4A–4D shows an alternative form of tube of this invention.
Figure 4A:
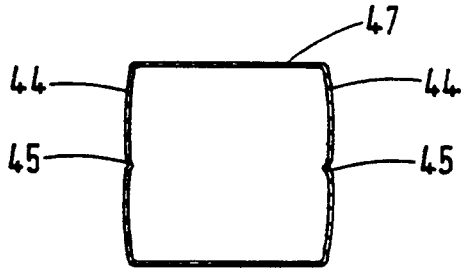
Figure 4B:
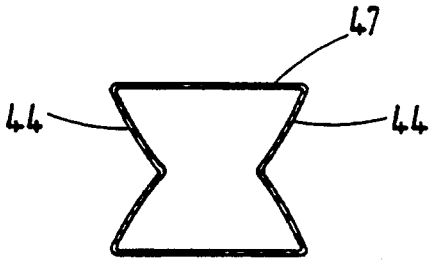
Figure 4C:
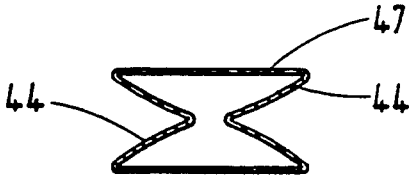

In use, a consumer may break the adhesion of adhesive 40 then 37, and fold up the flap 35 into an arrangement similar to FIG. 4C. The tube may then be compressed to extrude the contents (not shown). Alternatively consumers may choose not to break the adhesion but simply to compress the tube with its end closure as shown in FIG. 3E.

FIG. 4 shows an alternative form of the tube of this invention in which the closed end is sealed by a "fish-tail" seal, in which the fold of the closed end is accommodated more gently to the rectangular section further along the tube.

The tube is shown overall in FIG. 4, and consists of a tube 41 of substantially square cross section over approximately half of its length nearest to its open end 42 which is fitted with an essentially conventional nozzle and screw cap 43. Opposing side walls 44, are biassed toward inward deformation by longitudinal creases 45. The closed end of the tube is sealed by forming an end flap 46 described in more detail below.

FIGS. 4A–4D show cross sections through the tube about lines A—A, B—B, C—C and D—D at various distances from the open end 42 of the tube 41, D—D being a section through flap 46. The section shown in FIG. 4A is about a quarter of the way along the tube from the open end 42, and shows the substantially square cross section and the creases 45. The section shown in FIG. 4B is about two thirds of the way along the tube from the open end 42, and shows the inward deformation of the side walls 44. The section shown in FIG. 4C is about nine-tenths along the tube from the open end 42 and shows the considerably inward deformation of the tube near the closed end as the square section is accommodated to the end flap 46.

Figure 4D:
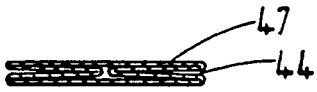

In FIG. 4D the section is through the end flap 46, in which the unbiassed side walls 47 and biassed side walls 44 are compressed substantially flat to form a seal, and are stuck together by an adhesive (now shown).

In the tube shown in FIG. 4 the accommodation of the inward fold of the side walls as at section D—D to the rectangular section as at A—A is achieved by a relatively gentle taper of the tube over this region. However it will be appreciated that this taper could be made more steep to result in a tube with a closed end similar in appearance to that shown in FIG. 1A, to result in a tube of more nearly tetragonal shape.

Figure 5A:
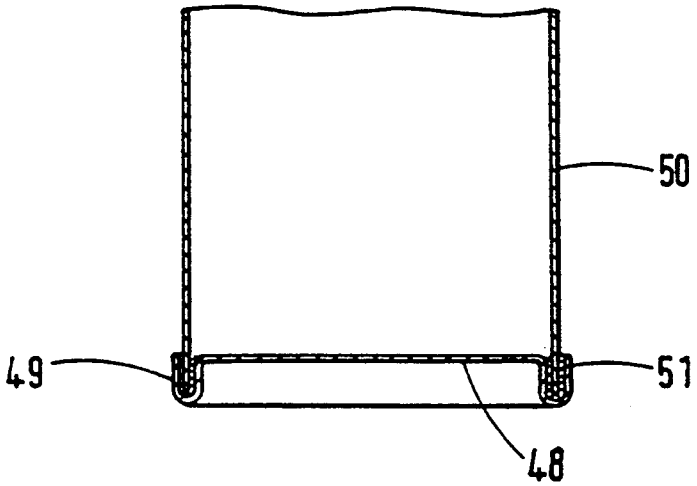
FIGS. 5A and 5B shows an alternative end closure arrangement.
Figure 5B:
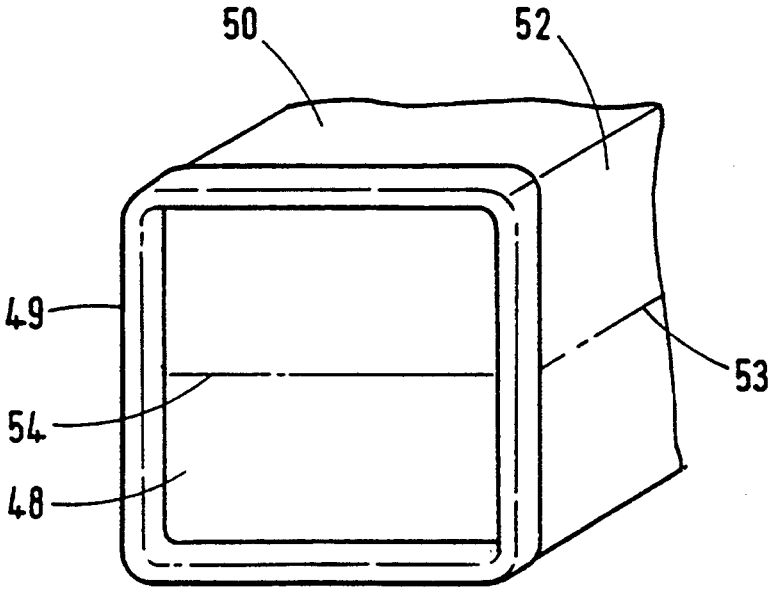

FIGS. 5A and 5B show an alternative form of end closure. A substantially flat end cap 48 having a peripheral grooved rim 49, corresponding to generally square shape of the end portion 50 of a tube as described above, is pre-formed.

The end portion 50 of the tube is introduced into the groove 49 of the end cap 48, and is sealed thereto by the use of an adhesive 51 in the groove and/or compression together.

In FIG. 5B the overall appearance of the sealed end of the tube is shown. Opposing side walls 52 of the tube 50 are biassed toward inward deformation by creases 53, and deformation of the end cap 48 is facilitated by creases 54 therein.

We claim:

1. A collapsible container for extrudable viscous fluids, comprising a tube of substantially rectangular cross section over substantially all of its length, opposing side walls being substantially longitudinally parallel over substantially the entire length of the tube, two opposing side walls of the tube being deformable by inward folding and being biased toward inward deformation under comprehensive pressure, said bias being by an inbuilt concavity in the form of a longitudinal crease in each of the opposing biased side walls running for substantially the entire length of the tube, the tube having one open end having a nozzle, and one closed end being substantially flat in a plane perpendicular to the length of the tube, at the closed end the non-biased side walls being brought together to form an external longitudinally extending flap extending substantially perpendicular to the closed end of the tube and capable of being folded flat against the closed end of the tube.

2. A collapsible container according to claim 1 wherein the closed end is formed by an inward first fold in each of the biased walls, said first fold being longitudinal and extending in the vicinity of the end to be closed for no more than 10% of the length of the tube, and thereby enabling the end of the tube to be folded substantially flat to form a longitudinally extending flap, by folding the inwardly folded biased walls between the non-biased walls, the consequent taper of the closed end of the tube being accommodated to the substantially rectangular cross-section of the tube by a second fold or bend in each of the non-biased side walls which are perpendicular to the biased side walls said second fold or bend extending across the width of the tube, the inward first fold of the biased wall being accommodated to the rectangular cross section of the tube by two third folds or bends extending from the first fold in the direction of the side walls perpendicular to the biased walls, said third folds or bends forming a substantially 'Y' shaped arrangement with the first fold, the longitudinally extending flap being folded substantially flat and into a plane substantially perpendicular to the length of the tube and lightly stuck against the flat closed end of the tube.

3. A collapsible container according to claim 2 wherein the closed end of the tube is formed by end regions of the non-biased side walls of the tube which are brought together whilst causing or allowing the adjacent inwardly-biased side walls to deform outwardly against their bias, so as to form a flap extending substantially in the direction of the long axis of the tube, regions of the non-inwardly biased side walls which are immediately adjacent to the flap being bent or folded to form a folded region which is substantially in a plane perpendicular to the length of the tube, the flap portion being folded or bent into contact with this folded region, and any parts of the flap which extend beyond the plane of the inwardly biased side walls being folded or bent into contact with the biased side walls.

4. A collapsible container according to claim 3 wherein the flap may be unfolded so that the flap extends longitudinally relative to the length of the tube, and then pulled to cause the immediately adjacent regions of the non-biased walls to be drawn together.

5. A collapsible container according to claim 4 wherein all the walls of the tube are deformable by hand pressure.

* * * * *